US008824712B2

(12) United States Patent
Sacha

(10) Patent No.: US 8,824,712 B2
(45) Date of Patent: Sep. 2, 2014

(54) METHOD AND APPARATUS FOR BEHIND-THE-EAR HEARING AID WITH CAPACITIVE SENSOR

(75) Inventor: Michael Karl Sacha, Chanhassen, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 172 days.

(21) Appl. No.: 12/905,444

(22) Filed: Oct. 15, 2010

(65) Prior Publication Data

US 2011/0091059 A1 Apr. 21, 2011

Related U.S. Application Data

(60) Provisional application No. 61/252,639, filed on Oct. 17, 2009, provisional application No. 61/253,358, filed on Oct. 20, 2009.

(51) Int. Cl.
*H04R 25/00* (2006.01)

(52) U.S. Cl.
USPC ..... 381/321; 381/324

(58) Field of Classification Search
USPC ..... 381/321, 324
See application file for complete search history.

(56) References Cited

U.S. PATENT DOCUMENTS

| | | | | |
|---|---|---|---|---|
| 2,140,969 | A | 12/1938 | William | |
| 2,930,857 | A | 3/1960 | Hollingsworth | |
| 3,787,732 | A | 1/1974 | Larson | |
| 4,204,036 | A | 5/1980 | Cohen et al. | |
| 4,290,052 | A | 9/1981 | Eichelberger et al. | |
| 4,419,995 | A | 12/1983 | Hochmair et al. | |
| 4,955,729 | A | 9/1990 | Marx | |
| 5,341,433 | A | 8/1994 | Meyer et al. | |
| 5,710,820 | A | 1/1998 | Martin et al. | |
| 5,774,557 | A * | 6/1998 | Slater | 381/56 |
| 6,069,963 | A | 5/2000 | Martin et al. | |
| 6,310,960 | B1 | 10/2001 | Saaski et al. | |
| 6,358,281 | B1 | 3/2002 | Berrang et al. | |
| 6,532,294 | B1 | 3/2003 | Rudell | |
| 6,610,440 | B1 | 8/2003 | LaFollette et al. | |
| 7,324,652 | B2 | 1/2008 | Preves et al. | |
| 2001/0043709 | A1 | 11/2001 | Panitzsch | |
| 2002/0145594 | A1 | 10/2002 | Derocher | |
| 2004/0179709 | A1 | 9/2004 | Niederdraenk et al. | |
| 2005/0047613 | A1 * | 3/2005 | Mallinson | 381/106 |
| 2005/0141740 | A1 | 6/2005 | Preves et al. | |

(Continued)

FOREIGN PATENT DOCUMENTS

| | | | |
|---|---|---|---|
| DE | 10136033 | A1 | 2/2003 |
| DE | 102004019353 | B3 | 9/2005 |

(Continued)

OTHER PUBLICATIONS

"European Application Serial No. 08251782.2, Office Action Response Filed: Dec. 21, 2010", 7 pgs.

(Continued)

*Primary Examiner* — Brian Ensey
*Assistant Examiner* — Katherine Faley
(74) *Attorney, Agent, or Firm* — Schwegman Lundberg & Woessner, P.A.

(57) ABSTRACT

Disclosed herein, among other things, are methods and apparatus for a behind-the-ear hearing aid with a capacitive sensor.

21 Claims, 13 Drawing Sheets

(56) References Cited

U.S. PATENT DOCUMENTS

| | | | | |
|---|---|---|---|---|
| 2005/0238190 | A1 | 10/2005 | Rohrlein | |
| 2005/0253814 | A1 | 11/2005 | Ghassabian | |
| 2006/0045304 | A1 | 3/2006 | Lee et al. | |
| 2006/0284853 | A1 | 12/2006 | Shapiro | |
| 2008/0089541 | A1 | 4/2008 | Preves et al. | |
| 2008/0170734 | A1* | 7/2008 | Major et al. | 381/322 |
| 2008/0192961 | A1* | 8/2008 | Radivojevic et al. | 381/151 |
| 2008/0292126 | A1 | 11/2008 | Sacha et al. | |
| 2009/0087004 | A1 | 4/2009 | Boguslavskij | |
| 2009/0123013 | A1 | 5/2009 | Leong | |
| 2009/0189769 | A1 | 7/2009 | Schaffler et al. | |
| 2009/0316941 | A1* | 12/2009 | Lowmiller et al. | 381/324 |
| 2009/0323975 | A1* | 12/2009 | Groesch | 381/71.1 |
| 2010/0322452 | A1 | 12/2010 | Ladabaum et al. | |
| 2011/0074444 | A1 | 3/2011 | Makiranta et al. | |
| 2011/0091058 | A1 | 4/2011 | Sacha et al. | |

FOREIGN PATENT DOCUMENTS

| | | | |
|---|---|---|---|
| DE | 102005044416 | A1 | 3/2007 |
| EP | 1496530 | A2 | 1/2005 |
| EP | 1496530 | A3 | 3/2005 |
| EP | 2043389 | A2 | 9/2008 |
| EP | 1995992 | A2 | 11/2008 |
| EP | 2282412 | A1 | 2/2011 |
| WO | WO-2007052189 | A2 | 5/2007 |
| WO | WO-2009118221 | A1 | 10/2009 |

OTHER PUBLICATIONS

"U.S. Appl. No. 11/943,182, Final Office Action mailed Jun. 9, 2011", 16 pgs.
"U.S. Appl. No. 11/943,182, Response filed May 16, 2011 to Non-Final Office Action mailed Nov. 15, 2010", 9 pgs.
"U.S. Appl. No. 12/126,779, Non Final Office Action mailed Jan. 25, 2011", 17 pgs.
"U.S. Appl. No. 12/126,779, Response filed Jul. 25, 2011 to Non-Final Office Action mailed Jan. 25, 2011", 9 pgs.
"European Application Serial No. 08251782.2, Office Action mailed Sep. 1, 2011", 7 pgs.
"European Application Serial No. 10251804.0, Extended European Search mailed May 26, 2011", 6 pgs.
"U.S. Appl. No. 11/943,182 , Response filed Dec. 7, 2011 to Final Office Action mailed Jun. 9, 2011", 8 pgs.
"U.S. Appl. No. 11/943,182, Final Office action mailed Jan. 19, 2012", 16 pgs.
"U.S. Appl. No. 12/126,779, Final Office Action mailed Oct. 31, 2011", 19 pgs.
"European Application Serial No. 08251782.2, Response filed Feb. 23, 2012 to Office Action mailed Sep. 1, 2011", 3 pgs.
"European Application Serial No. 10251804.0, Response filed Jan. 27, 2012 to Extended European Search mailed May 26, 2011", 9 pgs.
"European Application Serial No. 10251805.7, Extended Search Report mailed Apr. 4, 2012", 8 pgs.
"U.S. Appl. No. 10/749,133, Final Office Action mailed Mar. 16, 2007", 18 pgs.
"U.S. Appl. No. 10/749,133, Non Final Office Action mailed Apr. 18, 2006", 15 pgs.
"U.S. Appl. No. 10/749,133, Non Final Office Action mailed Oct. 2, 2006", 5 pgs.
"U.S. Appl. No. 10/749,133, Notice of Allowance mailed Sep. 7, 2007", 7 pgs.
"U.S. Appl. No. 10/749,133, Response filed Jan. 2, 2007 to Non Final Office Action mailed Oct. 2, 2006", 8 pgs.
"U.S. Appl. No. 10/749,133, Response filed Jun. 18, 2007 to Final Office Action mailed Mar. 16, 2007", 14 pgs.
"U.S. Appl. No. 10/749,133, Response filed Jul. 18, 2006 to Non Final Office Action mailed Apr. 18, 2006", 14 pgs.
"U.S. Appl. No. 11/943,182, Non Final Office action mailed Nov. 15, 2010", 22 pgs.
"European Application Serial No. 08251782.2, Extended European Search Report Mailed Nov. 2, 2009", 7 pgs.
"European Application Serial No. 08251782.2, Office Action mailed Jun. 11, 2010", 5 pgs.
U.S. Appl. No. 12/126,779, Appeal Brief filed Oct. 2, 2012, 15 pgs.
U.S. Appl. No. 12/126,779, Examiner's Answer to Appeal Brief mailed Dec. 12, 2012, 6 pgs.
U.S. Appl. No. 12/905,421, Final Office Action mailed Jan. 18, 2013, 11 pgs.
U.S. Appl. No. 12/905,421, Non Final Office Action mailed Aug. 3, 2012, 10 pgs.
U.S. Appl. No. 12/905,421, Response filed Jan. 3, 2013 to Non Final Office Action mailed Aug. 3, 2012, 14 pgs.
European Application Serial No. 10251805.7, Response filed Oct. 31, 2012 to Extended Search Report mailed Apr. 4, 2012, 11 pgs.
European Application Serial No. 10251805.7, Examination Report mailed Dec. 12, 2012, 6 pgs.
European Application Serial No. 10251805.7, Response filed Mar. 26, 2013 to Examination Report mailed Dec. 12, 2012, 10 pgs.
Albus, Zack, "PCB-Based Capacitive Touch Sensing with MSP430", Texas Instruments Application Report, No. SLAA363A, (Oct. 1, 2007), 1-25.
"U.S. Appl. No. 12/905,421, Non Final Office Action mailed Jun. 3, 2013", 12 pgs.
"U.S. Appl. No. 12/905,421, Response filed May 20, 2013 to Final Office Action mailed Jan. 18, 2013", 9 pgs.
"European Application Serial No. 08251782.2, Summons to Attend Oral Proceedings mailed Mar. 15, 2013", 4 pgs.
"U.S. Appl. No. 12/905,421 , Response filed Sep. 3, 2013 to Non Final Office Action mailed Jun. 3, 2013", 9 pgs.
"U.S. Appl. No. 12/905,421, Final Office Action mailed Sep. 17, 2013", 10 pgs.
"U.S. Appl. No. 12/905,421, Response filed Nov. 18, 2013 to Final Office Action mailed Sep. 17, 2013", 9 pgs.
"U.S. Appl. No. 12/905,421, Advisory Action mailed Nov. 29, 2013", 3 pgs.
"European Application Serial No. 08251782.2, EPO Written Decision to Refuse mailed Dec. 11, 2013", 11 pgs.

* cited by examiner

PROFILE OPTIONS
(TO HELP USER LOCALIZATION)

METHOD AND APPARATUS FOR BEHIND-THE-EAR HEARING AID WITH CAPACITIVE SENSOR

CLAIM OF PRIORITY

The present application claims the benefit under 35 USC 119 of U.S. Provisional Patent Application Ser. No. 61/252,639 filed on Oct. 17, 2009 and U.S. Provisional Patent Application Ser. No. 61/253,358 filed on Oct. 20, 2009, which are both incorporated herein by reference in their entirety.

FIELD OF THE INVENTION

The present subject matter relates generally to hearing aids, and in particular to an behind-the-ear hearing aid with capacitive sensor.

BACKGROUND

The smaller a hearing aid becomes, the more difficult it can be to put in the ear, take out of the ear, and to operate. Even simple switching of the device becomes more difficult as the device becomes smaller. The controls on a behind-the-ear hearing aid (BTE hearing aid) can be difficult to access and to operate.

Thus, there is a need in the art for a system for improved controls for hearing aids. There is a need in the art for improved controls for behind-the-ear hearing aids.

SUMMARY

Disclosed herein, among other things, are methods and apparatus for a behind-the-ear hearing aid with a capacitive sensor. In various embodiments, the present subject matter includes apparatus for use by a wearer, including: a behind-the-ear housing having an outer surface; hearing assistance electronics; capacitive sensing electronics connected to the hearing assistance circuit; and a plurality of electrodes placed on or near the outer surface of the housing and connected to the capacitive sensing circuit, wherein the capacitive sensing electronics are adapted to detect motion of the wearer in proximity of the plurality of electrodes. In various embodiments, the hearing assistance electronics are adapted to perform switch functions in response to a detection of the motion. In various embodiments, the hearing assistance electronics are adapted to perform adjustable control functions in response to a detection of the motion. In various embodiments, the hearing assistance electronics are adapted to perform volume up and volume down functions in response to a sweeping motion performed at different positions along the plurality of electrodes. In various embodiments, the hearing assistance electronics are adapted to perform one or more functions in response to a tapping motion performed at different positions along the plurality of electrodes. In various embodiments, the apparatus includes a portion contoured to accommodate a finger. In various embodiments, the apparatus includes means for assisting the wearer to in locating controls of the apparatus, the controls including the plurality of electrodes. In various embodiments, the apparatus includes a hybrid sensing switch including the plurality of electrodes and a piezoelectric element.

In various embodiments, the present subject matter provides methods for operating a behind-the-ear hearing aid, including: detecting a change in capacitance using a plurality of electrodes placed on or near an outer surface of a housing of the hearing aid, the change in capacitance associated with motion of a wearer in proximity of the plurality of electrodes. In various embodiments, the methods include performing a switch or adjustable control function in response to a detection of the change in capacitance. In various embodiments, the methods include detecting the change in capacitance associated with taps. In various embodiments, the methods include detecting the change in capacitance associated with sweeps. In various embodiments, the methods include detecting the change in capacitance associated with static presses. In various embodiments, the methods include detecting the change in capacitance associated with patterns of motions. In various embodiments, the methods include adjusting a sensitivity for the detecting the change in capacitance to reduce false triggers.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter of the invention relates generally to method and apparatus for a behind-the-ear (BTE) hearing aid with a capacitive sensor. In various embodiments, the capacitive sensor provides a switching function. In various embodiments, the capacitive sensor provides an adjustable control. Other functions are provided by the present subject matter.

Throughout this application it is understood that references to BTE can provide aspects of the present subject matter that can be applied to any device that resides on or over the ear, including, but not limited to receiver-in-the-canal (RIC) and receiver-in-the-ear (RITE) hearing aids.

The following disclosures are hereby incorporated by reference in their entirety: U.S. Provisional Patent Application Ser. No. 60/940,041 filed May 24, 2007; U.S. patent application Ser. No. 12/126,779 filed May 23, 2008; and U.S. Provisional Patent Application Ser. No. 61/252,636, filed Oct. 16, 2009.

Figure 1:
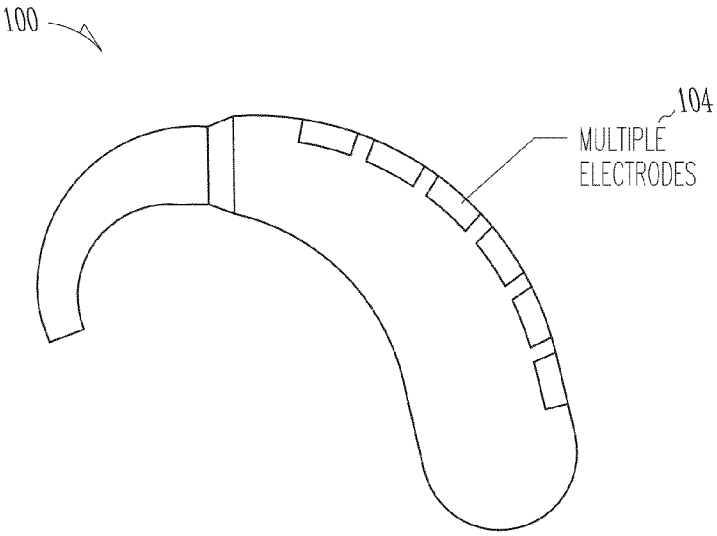
FIG. 1 shows one example of a behind-the-ear housing having a plurality of electrodes for capacitive sensing, according to one embodiment of the present subject matter.

FIG. 1 shows one example of a behind-the-ear housing having a plurality of electrodes for capacitive sensing, according to one embodiment of the present subject matter. The housing 100 includes a plurality of electrodes 104 placed on or near the outer surface of the housing 100. These electrodes are connected to hearing assistance electronics that are adapted to sense proximity of the wearer's finger. In various embodiments, different combinations of capacitive sensing electronics can be combined with hearing assistance electronics. Different configurations include integrated circuit approaches which combine the digital signal processing used by the hearing assistance electronics with interrupt driven capacitive sensing electronics; approaches where a digital signal processor is interfaced with a level translator to translate voltage differences between parts; and approaches where the digital signal processor interfaces directly with the capacitive sensing device electronics. Some designs are provided by the circuits discussed in U.S. Provisional Patent Application Ser. No. 61/252,636 filed Oct. 16, 2009, entitled Method and Apparatus for In-the-Ear Hearing Aid with Capacitive Sensor, which is incorporated herein by reference in its entirety.

The wearer can provide a number of different motions including, but not limited to, taps, sweeps, static presses, patterns of the these and combinations thereof. Thus, the present subject matter can provide a number of functions using various movements and actions by the wearer.

Figure 2A:
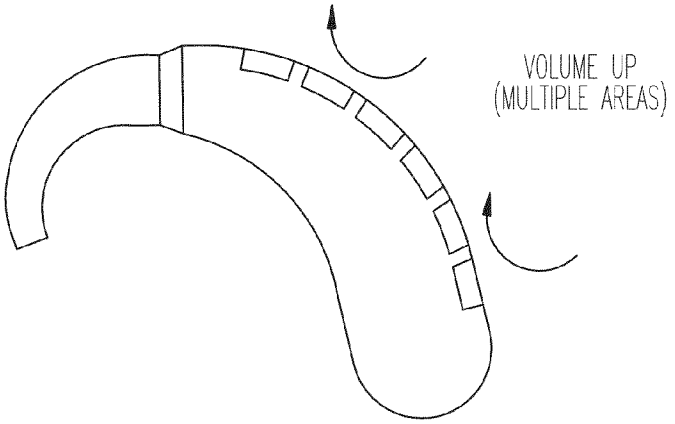
FIGS. 2A and 2B demonstrate various sweeping motions at different locations for controlling the device of FIG. 1, according to various embodiments of the present subject matter.
Figure 2B:
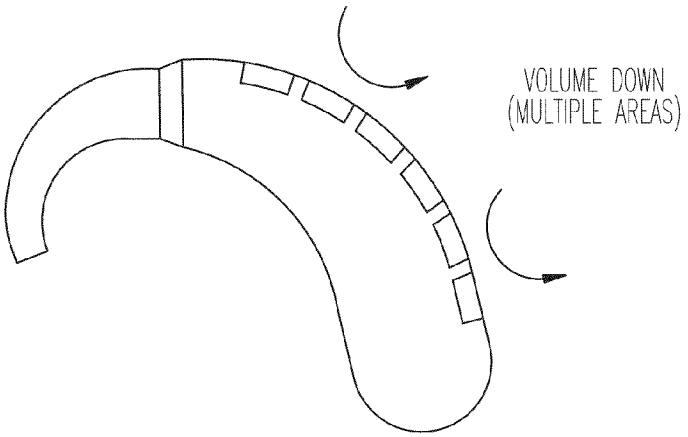

FIGS. 2A and 2B demonstrate various sweeping motions at different locations for controlling the device of FIG. 1, according to various embodiments of the present subject matter. FIG. 2A demonstrates that a sweeping motion can be performed at different positions along the plurality of sensor electrodes to perform a volume up function, according to one embodiment of the present subject matter. FIG. 2B demonstrates that a sweeping motion can be performed at different positions along the plurality of sensor electrodes to perform a volume down function, according to one embodiment of the present subject matter. It is understood that these functions are demonstrative of a number of different possible functions that can be supported by the present subject matter and are not exhaustive or exclusive of the possible applications.

Figure 3:
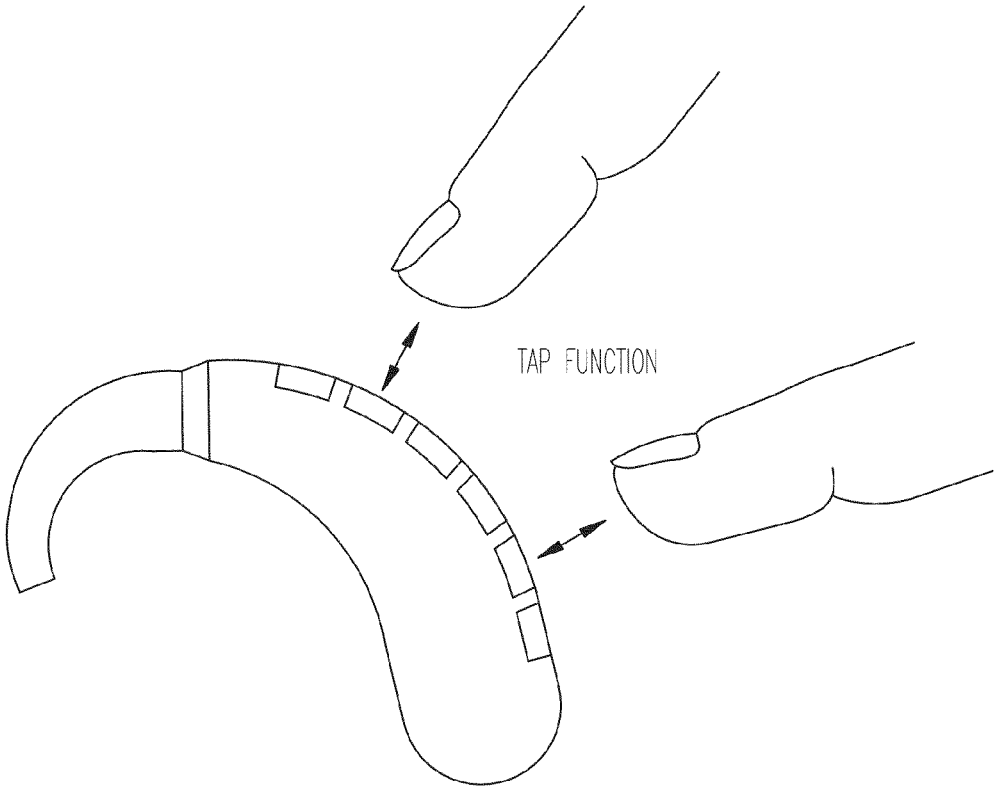
FIG. 3 demonstrates a tapping motion performed at different positions along the plurality of sensor electrodes to perform one or more functions, according to various embodiments of the present subject matter.

FIG. 3 demonstrates a tapping motion can be performed at different positions along the plurality of sensor electrodes to perform one or more functions according to various embodiments of the present subject matter. Taps at any sensor can be used to perform the same function (for example, a memory or mode change), or can be used to perform different functions (for example, a tap at the top of the range of sensor electrodes can provide a high volume and a tap at the low range of sensors can provide a low volume). Various different tapping approaches can be used to support a variety of device settings and functions.

Figure 4:
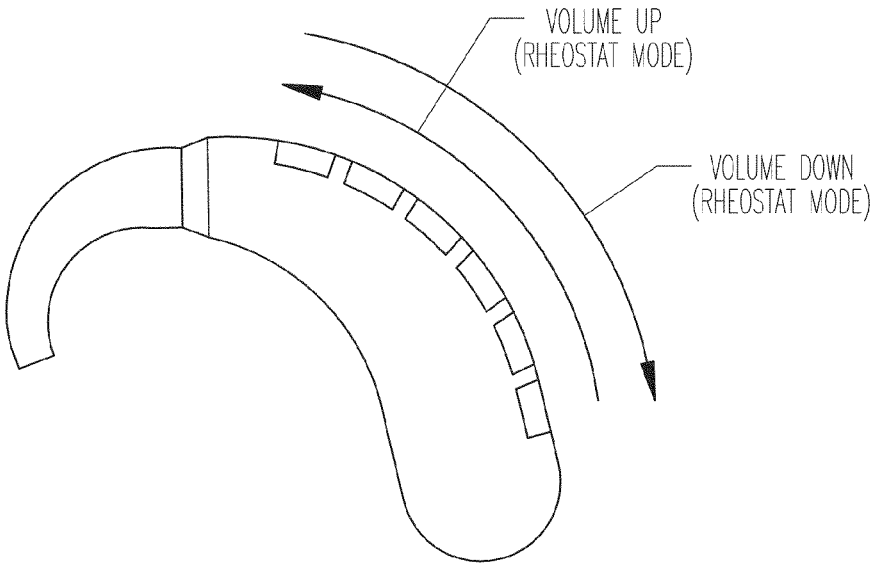
FIG. 4 demonstrates the plurality of sensor electrodes used in a rheostat mode to provide adjustment, according to various embodiments of the present subject matter.

FIG. 4 demonstrates that the plurality of sensor electrodes can be used in a rheostat mode to provide adjustment, according to various embodiments of the present subject matter. For example, by sliding or motioning along the device, the wearer can adjust volume to a desired setting much like a potentiometer or rheostat. It is understood that by providing this function any parameter can be adjusted across a parameter range. Such adjustment can be programmable. For example, the adjustment can be linear or logarithmic. The adjustment can have static or variable levels of adjustability. Thus, the sensors provide a great deal of programmable flexibility as the device can serve to adjust a plurality of parameters based on the programming of the device.

Figure 5B:
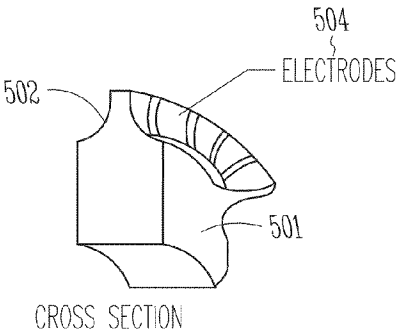
FIGS. 5A and 5B demonstrate how the area of the sensor electrodes can be contoured, according to various embodiments of the present subject matter.
Figure 5A:
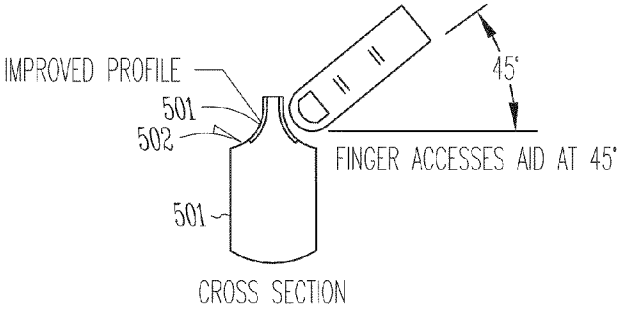
Figure 7:
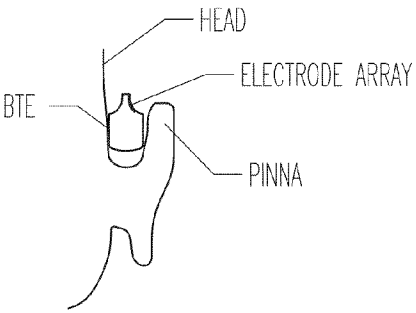
FIG. 7 shows one example of deactivating a row of sensors of the device of FIGS. 5A and 5B that are nearest the head of the wearer, according to various embodiments of the present subject matter.

FIGS. 5A and 5B demonstrate how the area of the sensor electrodes can be contoured, according to various embodiments of the present subject matter. The contouring of the device 501 portion to accommodate a finger can help a wearer to locate the active area and to protect the sensor from false triggers. For example, the contouring can prevent false triggers from the Pinna or head due to proximity or touches of the sensor electrodes 501. In various embodiments, the row of electrodes proximal to the head can be disabled to further reduce the risk of false triggers due to head touches. This can also reduce the number of false triggers due to head perspiration. FIG. 7 shows one example of deactivating a row of sensors of the device of FIGS. 5A and 5B that are nearest the head of the wearer, according to various embodiments of the present subject matter. Such deactivation can be performed programmably. Thus, designs can be made with sensor electrodes on both sides of the ridge and thereby forming a housing that can be used for either left or right uses.

Figure 6:
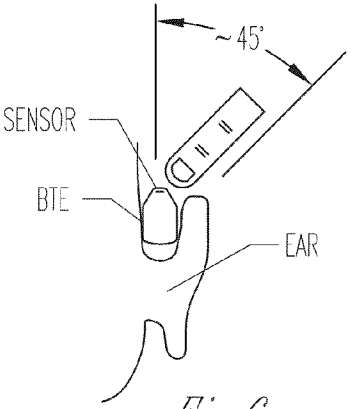
FIG. 6 shows one example of the device of FIGS. 5A and 5B worn on the wearer's ear, according to one embodiment of the present subject matter.

FIG. 6 shows one example of the device of FIGS. 5A and 5B worn on the wearer's ear, according to one embodiment of the present subject matter. Access at about 45 degrees from the side of the head with the wearer's finger is enhanced with the design, according to one embodiment of the present subject matter.

Figures 8A, 8B, 8C, 8D, 8E:
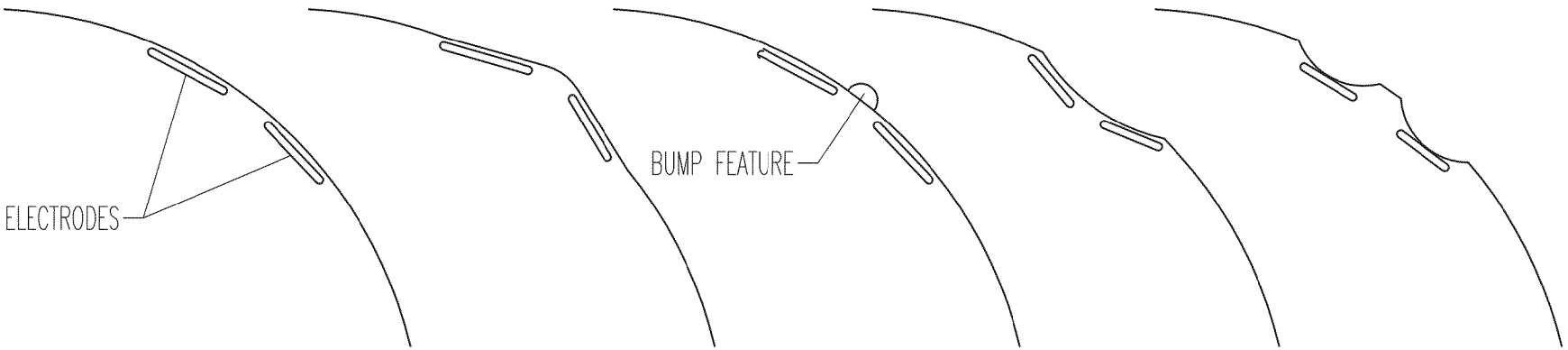
FIGS. 8A to 8E demonstrate different profile and electrode configurations employed to assist the wearer in locating the controls of the present device, according to various embodiments of the present subject matter.

FIGS. 8A to 8E demonstrate that different profile and electrode configurations can be employed to assist the wearer in locating the controls of the present device, according to various embodiments of the present subject matter. FIG. 8A shows one example where the electrodes are located on or near a curved surface of the device, according to one embodiment of the present subject matter.

FIG. 8B shows one example where the electrodes are located on or near a curved surface of the device having an angled profile to assist the wearer in locating a first region as opposed to a second region, according to one embodiment of the present subject matter. FIG. 8C shows one example where the electrodes are located on or near a curved surface of the device having a profile with a bump to assist the wearer in locating a first region as opposed to a second region, according to one embodiment of the present subject matter. FIG. 8D shows one example where the electrodes are located on or near a surface of the device having a profile with a recess to assist the wearer in locating the active region of the sensor electrodes, according to one embodiment of the present subject matter. FIG. 8E shows one example where the electrodes are located on or near a curved surface of the device having a profile with two recesses to assist the wearer in locating a first region as opposed to a second region, according to one embodiment of the present subject matter.

Figure 9:
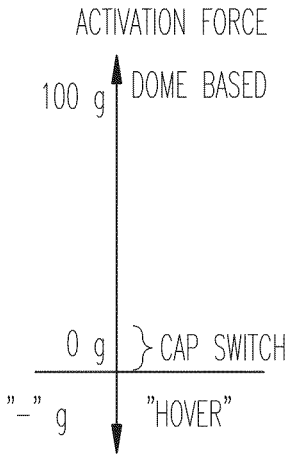
FIGS. 9 and 10 show generally the activation force needed for capacitive switches versus piezoelectric/other switches.
Figure 10:
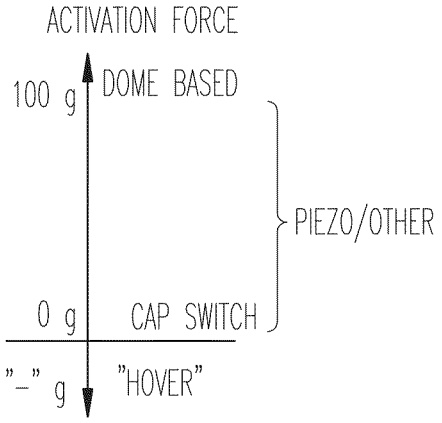

Thus, the various embodiments of the present subject matter demonstrate that the wearer can benefit by not having to locate specific area on the device. The device itself is a sensor in various embodiments. This is easier for the wearer to use the device. Another benefit is that capacitive sensing technology is substantially easier to activate than other technologies. FIGS. 9 and 10 show generally the activation force needed for capacitive switches versus piezoelectric/other switches.

The sensitivity of the present design can be adjusted to allow more or less pressure to activate the capacitive sensor/switch. In various embodiments the sensitivity of the capacitive sensing is decreased to make the device provide fewer false triggers. This can also be done to facilitate use by wearers having decreased tactile function and/or sensitivity. In various embodiments, hybrid circuits of capacitive and other switches can be employed to move the activation force to the center of the range and thereby provide a more mechanical feel for the wearer.

In various embodiments, the sensitivity and touch duration are adjustable for various applications. The adjustment can be based on user habits or features. For example, a user with smaller finger size may benefit from a more sensitive switch. Such adjustments can be accomplished in a variety of ways including, but not limited to a fitting session and/or a training mode.

Figure 11:
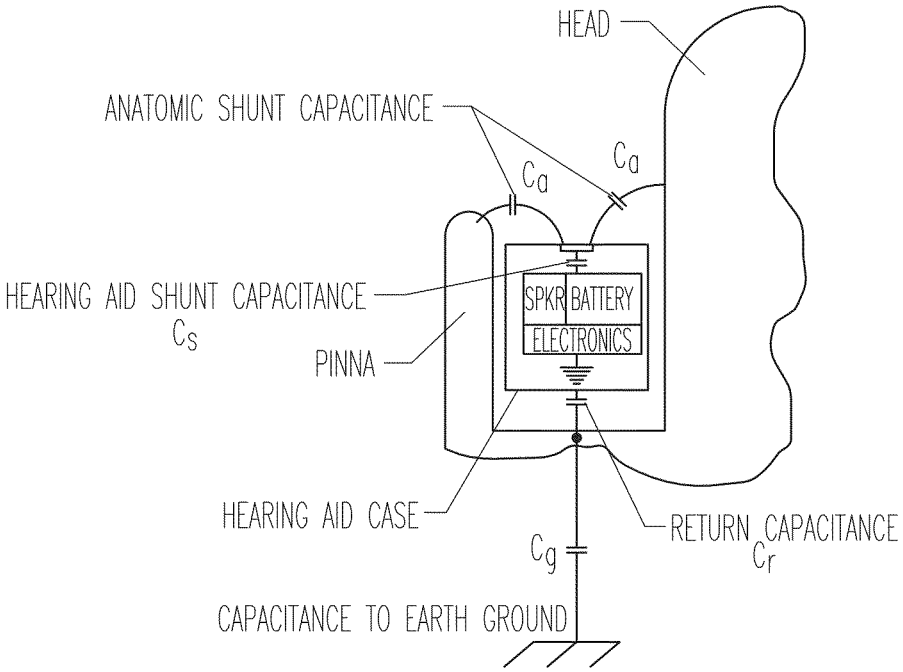
FIG. 11 shows some modeled capacitances associated with a behind-the-ear device having a capacitive switch, according to one embodiment of the present subject matter.

FIG. 11 shows some modeled capacitances associated with a behind-the-ear device having a capacitive switch, according to one embodiment of the present subject matter. A capacitance between ground and the body of the wearer is modeled as capacitance Cg (for "earth ground capacitance"). A capacitance between the body and the BTE device ground is modeled as Cr (for "return capacitance"). A capacitance of the sensor contact to the finger is Cf (for "finger capacitance," not shown), and from the sensor to the battery of the ITE device is Cs (for "shunt capacitance"). The capacitance between the sensor contact and the body of the wearer is Ca (for "anatomy capacitance").

Figure 12B:
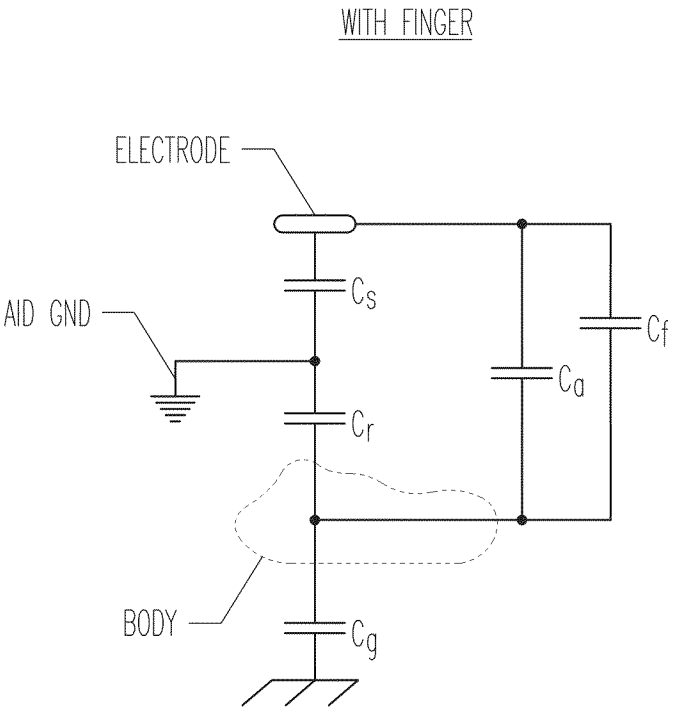
FIGS. 12A and 12B show equivalent circuit models for an ITE hearing aid with a capacitive sensor, according to one embodiment of the present subject matter.
Figure 12A:
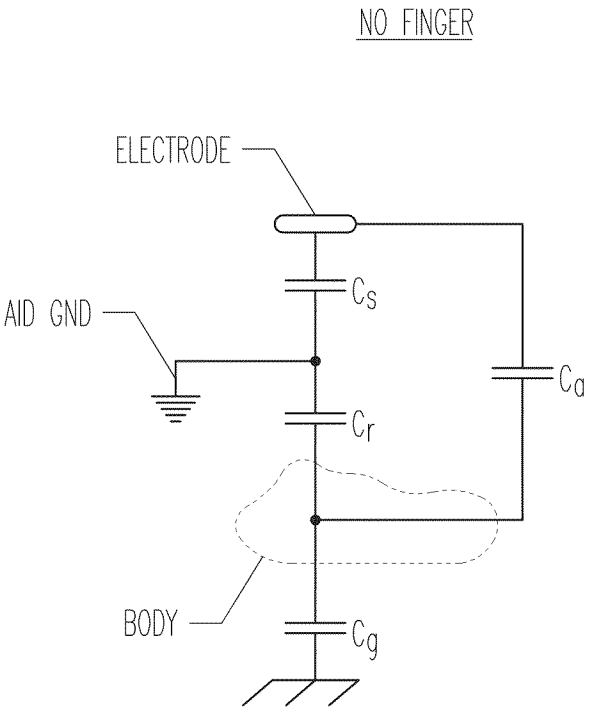

FIGS. 12A and 12B show equivalent circuit models for an ITE hearing aid with a capacitive sensor, according to one embodiment of the present subject matter. FIG. 12A shows the model without a finger and FIG. 12B shows the model with a finger in proximity to the sensor. As the wearer's finger comes into proximity of the contact or electrode, the capacitance between the finger and the contact, Cf, is effectively parallel with the anatomy capacitance, Ca. The change in capacitance by the adding of Cf to Ca ($\Delta C$) is sensed by the device's electronics to determine that the wearer's finger is in proximity to the sensor. If Cr (the "return" capacitance) becomes exceedingly small, there may not be enough change in capacitance ($\Delta C$) to register switch activation. Thus, switch sensitivity is at least partially governed by this capacitance. This can be avoided by selecting appropriate capacitor sensing technology, mechanical design, and device setup.

The hearing aid environment is a challenging application for capacitive switch technology because the sensing electrode is small, there is a high shunt capacitance due to anatomic proximity, there are high shunt capacitances due to hearing aid component proximity and the system is physically small. These factors effectively reduce the sensitivity of the switch. Careful placement of sensors and attention to detail switch design are necessary to minimize the total shunt capacitance value. Also, adding strategic ground traces around the switch sensor electrode can help shape sensitivity area.

Capacitive switch technology has many benefits within hearing aids, such as light touch for activation, larger size target, unique user interface options (sweeping), sealing out environmental conditions, minor volume requirements (smaller) and other previously mentioned benefits. But in hearing aid applications, complications due to water/moisture/perspiration can cause unintended triggers. Also, due to the larger sensing area, lighter touch requirements, compared to traditional mechanical switches, inadvertent triggers are possible due to gestures such as hugging.

Figure 13:
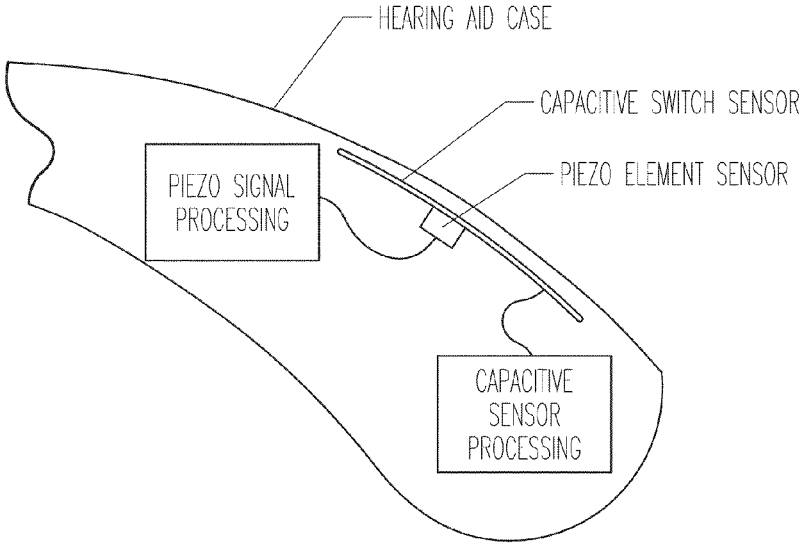
FIG. 13 shows one example where a capacitive sensor and a piezoelectric element sensor are combined, according to one embodiment of the present subject matter.

In various applications two sensing technologies, forming a hybrid sensing switch may provide a very robust switch sensing scheme. FIG. 13 shows one example where a capacitive sensor and a piezoelectric element sensor are combined, according to one embodiment of the present subject matter. The capacitive sensor is adapted to detect proximity or very light touches, but may be less reliable in wet conditions. The piezoelectric element is largely unaffected by moisture and the "tap" of the finger can be sensed by the piezoelectric element. The piezoelectric element is sensitive to vibrations, so during a short decision window a piezoelectric response can be detected as a valid finger tap. The device can take inputs from both sensors and use programming to make a detection decision. In various embodiments, the user's need to know exactly where the switches reside can be reduced by including other sensors, such as a plurality of sensors across the device or a combination of sensor pads with accelerometers so that each side of the device can be a different switch and each switch can cover the entire side of the device to eliminate the need to locate a switch precisely. Other switch combinations are possible without departing from the scope of the present subject matter.

Figure 14:
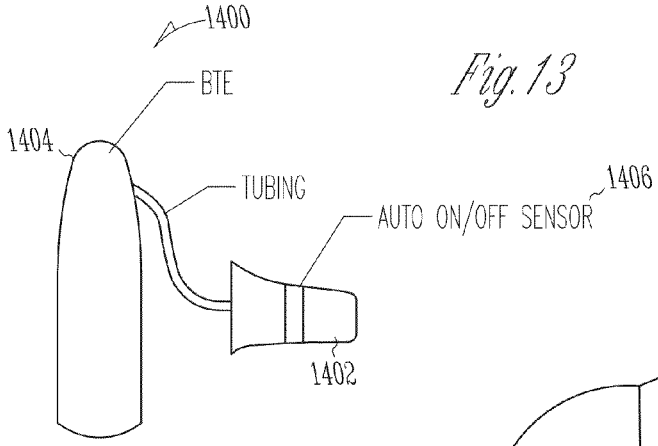
FIGS. 14 and 15 show examples of additional sensor locations, according to various embodiments of the present subject matter.
Figure 15:
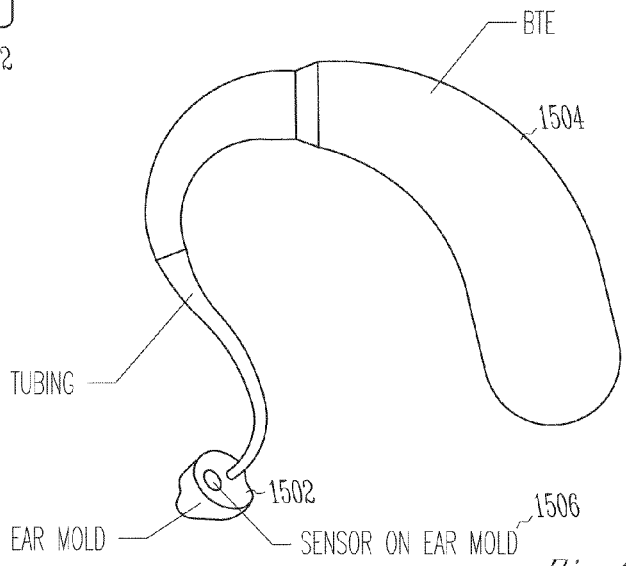

FIGS. 14 and 15 show examples of additional sensor locations, according to various embodiments of the present subject matter. FIG. 14 shows that an in-the-ear component 1402 of the overall hearing assistance device 1400 may include a capacitive sensor 1406 which can be used to perform functions by the BTE portion 1404, or by the in-the-ear portion 1402, or both, in various embodiments. In one application the sensor acts like an on/off sensor or switch as was described in U.S. Provisional Patent Application Ser. No. 61/252,636 filed Oct. 16, 2009, and incorporated by reference above in its entirety. The sensor can be used to indicate an improperly seated in-the-ear component (e.g., ear mold), or that the in-the-ear component is coming out of the wearer's ear. FIG. 15 shows a sensor on a different portion of the ear mold 1502. In various embodiments, the sensor can be used by the BTE portion 1504 or by the in-the-ear portion 1502 or both. It is understood that the devices include, but are not limited to BTE devices and RIC or RITE devices. Other devices can use sensors as shown without departing from the scope of the present subject matter.

Figure 16:
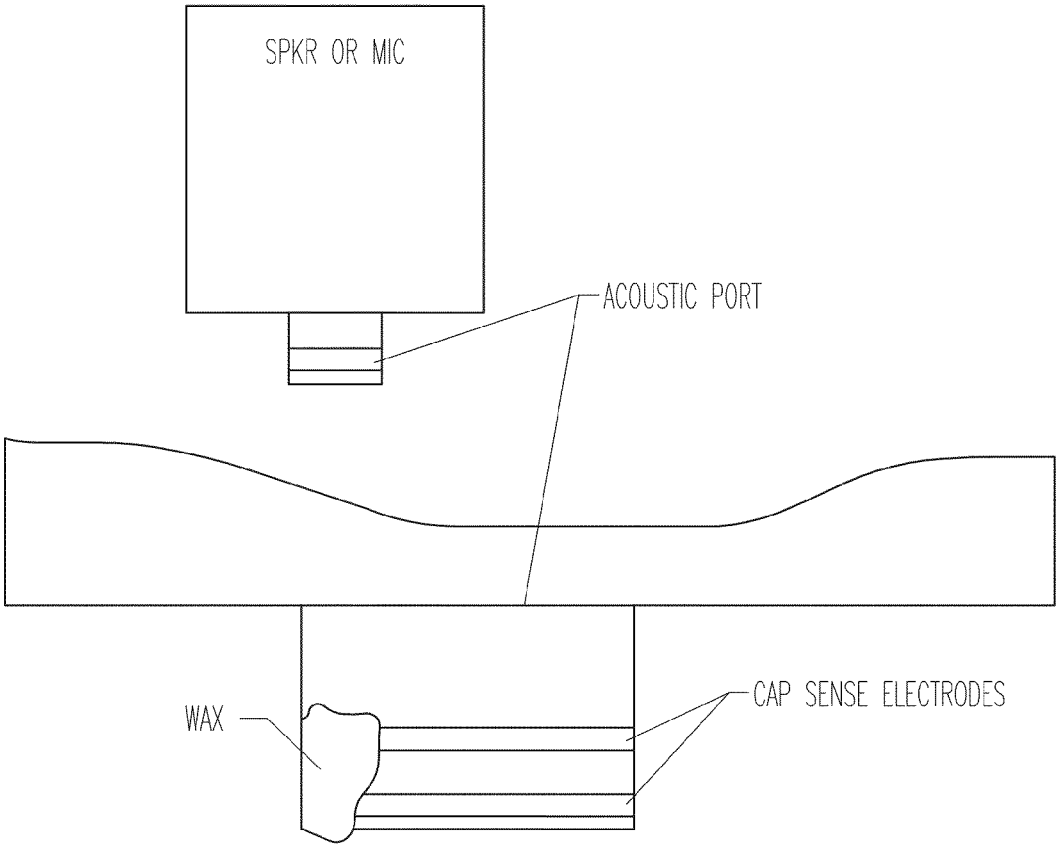
FIG. 16 demonstrates capacitive sense technology used for wax detection applications, according to various embodiments of the present subject matter.

FIG. 16 demonstrates that capacitive sense technology can also be used for wax detection applications, according to various embodiments of the present subject matter. Wax that spans across sensing electrodes can be detected. This can be applied to detect wax in various places including, but not limited to, speaker ports, microphone ports, microphone plumbing, speaker plumbing, and combinations thereof in general. Upon detection the user can be notified to either service aid themselves or take the aid to an audiologist.

In normal configurations, the capacitive switch will detect a conductive material between its sensors. In some applications, such as wax detection, a capacitive switch technology that can detect dielectric materials should be employed. Such systems can be configured to register a logic output upon detection. This logic signal can then be used by the hearing aid to notify user of impending port blockage.

To help minimize moisture/water issues with capacitive switches, at least one of a hydrophobic coating, superhydrophobic coating, oleophobic coating, and combinations thereof (for example an omniphobic coating which is superhydrophobic and oleophobic) can be applied to outer surfaces of the switch to promote beading of water/perspiration instead of wetting. Such coatings can be applied to seams, surrounding areas (such as an adjacent microphone cover), and internal portions of the sensor/switch and/or device in various embodiments. It is understood that hydrophobic coating, superhydrophobic coating, oleophobic coating, and combinations thereof (for example an omniphobic coating which is superhydrophobic and oleophobic) surfaces may be used without relying on a specific coating process. A water film that covers the switch area and also contacts the body will result in unwanted switch triggering. The beading of this moisture could help break up wetted surfaces.

An undesirable condition is when moisture contacting the sensor area also contacts the body. This condition reduces detection quality because the circuit may have difficulty distinguishing between a finger activation and moisture because a "good" shunt path is created by both. The coatings described herein can reduce the buildup of moisture. Thus these coatings/surfaces can enhance the operation of the hearing aid under a variety of different conditions.

Figure 17:
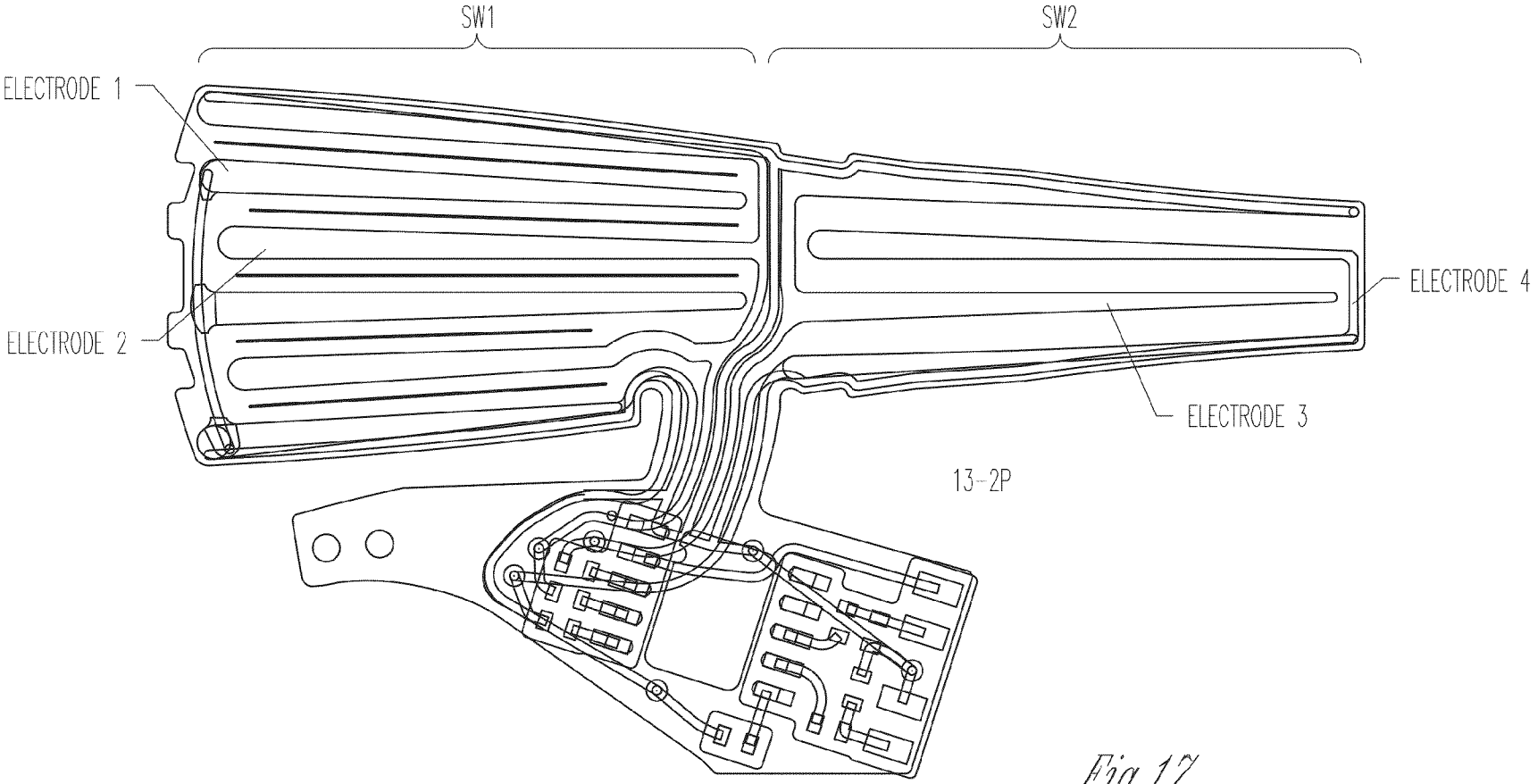
FIG. 17 shows a metalized layer used in one application of the present capacitive sensing technology.
Figure 18:
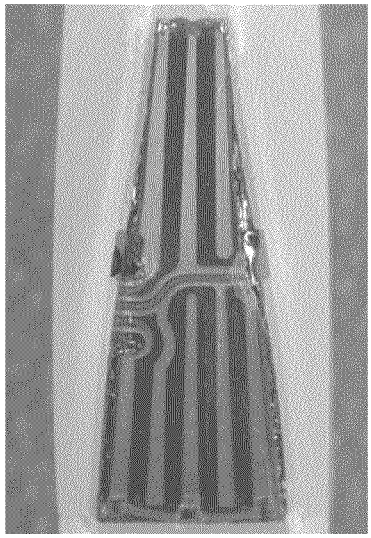
FIGS. 18 and 19 show different trace layouts on flex circuits according to various embodiments of the present subject matter.
Figure 19:
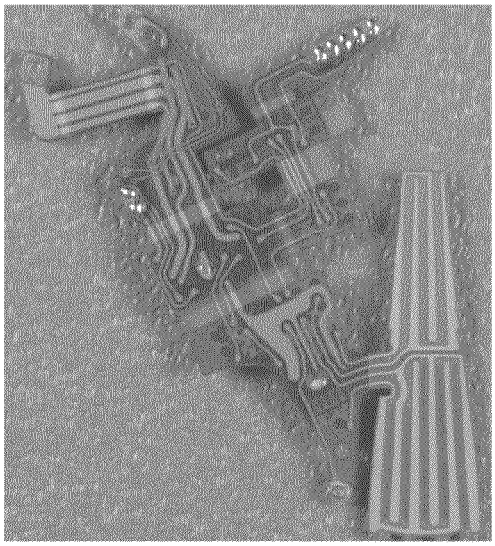

FIG. 17 shows a metalized layer used in one application of the present capacitive sensing technology. The metalized layer features fingers that are interposed to facilitate capacitive sensing. The circuit is adapted to provide a first switching layout (SW1) using electrodes 1 and 2 and a second switching layout (SW1) using electrodes 3 and 4. This design provides two switch zones. Thus, sweeps from top to bottom or bottom to top are detectable. In various embodiments, ground traces are incorporated to help confine electric field lines to specific areas thus helping to define switch zones. Ground traces can limit the influence of adjacent pieces of anatomy. FIGS. 18 and 19 show different trace layouts on flex circuits according to various embodiments of the present subject matter. Thus, the flex circuits can be populated with electronics and placed inside a package.

Figure 20:
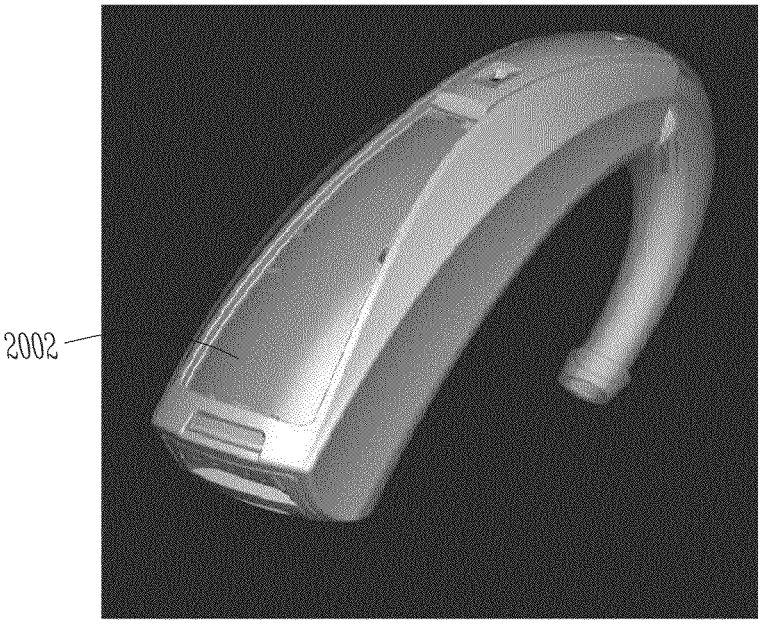
FIGS. 20 and 21 show different behind-the-ear housing designs where the sensor areas 2002 and 2102 are shown, according to various embodiments.
Figure 21:
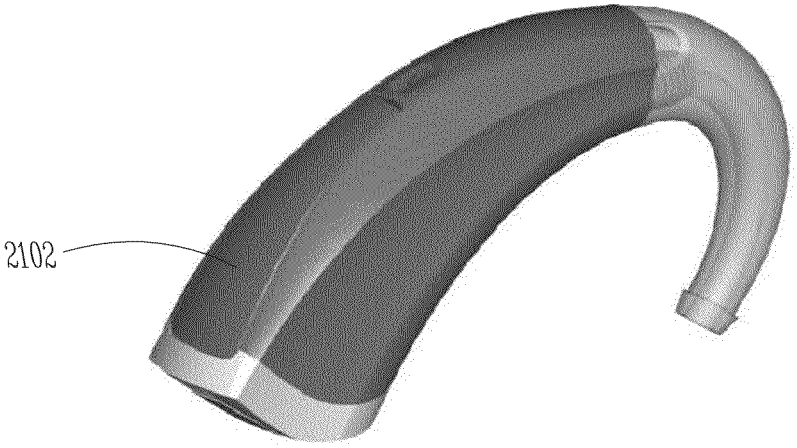
Figure 22:
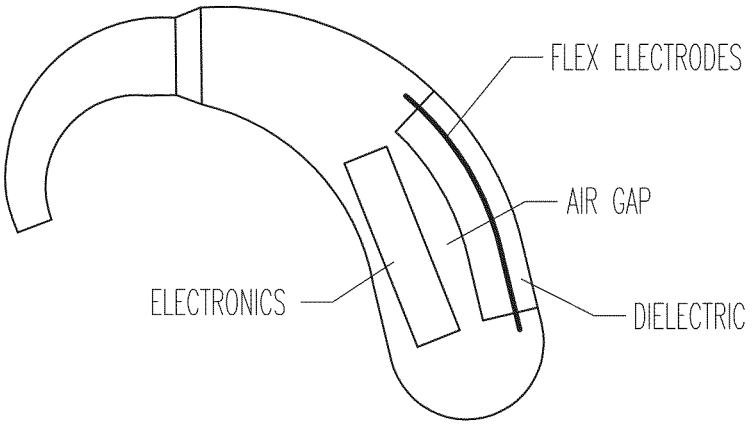
FIG. 22 shows a cross section where the flex electrodes are covered with a dielectric, according to various embodiments of the present subject matter.

FIGS. 20 and 21 show different behind-the-ear housing designs where the sensor areas 2002 and 2102 are shown, according to various embodiments. In some embodiments, the flexible circuit is covered with a dielectric material and the area under the flex circuit is designed to have an air gap to increase the electric field away from the internal electronics of the housing. FIG. 22 shows a cross section where the flex electrodes are covered with a dielectric to provide a higher dielectric coefficient in the plastic (ranging from about 3 to 6 in various embodiments) than the air (dielectric coefficient of 1) in the air gap. This reduces the shunting of the energy of the field to the electronics because the field is encouraged to reside outside of the housing by the dielectric effect.

In various embodiments, a sleep/wake-up mode is used to reduce false triggers. In one embodiment, a tap of the sensor/switch will "wake up" the switch and another tap or sweep or other motion will activate other switch functionalities. In various embodiments, different motions can be used without departing from the scope of the present subject matter.

Other power saving approaches include, but are not limited to adjusting triggering threshold adaptively. In one embodiment, a communications link can be used to make the adjustment. In one embodiment, an i2c bus is used as a means for adaptively adjusting triggering threshold. Other approaches are possible without departing from the scope of the present subject matter.

In various embodiments, the motions associated with triggering a sense by the sensors is a tap. In various embodiments, the motion is a sweep of the finger. In various embodiments a tap and a sweep are distinguished by the device to perform different functions. In various embodiments, the sweep speed or direction connotes a velocity or change in magnitude of a particular parameter. In various embodiments, multiple taps or tap patterns can be employed to perform different functions or rates of changes of parameters. Thus, several approaches are possible without departing from the scope of the present subject matter.

In various embodiments the area or region near the sensor/switch is textured to provide the wearer with information as to where the switch is located. In various embodiments, a color coded area denotes where the sensor/switch is located or most sensitive. In various embodiments, a material having different tactile response is used to identify an area at or near the sensor/switch.

In various embodiments readings from the sensor/switch are used to determine if the hearing device is in use. In various embodiments readings from the sensor/switch are used to determine if the hearing device has changed positions. In some embodiments, a long term time constant is used to process sensor/switch readings and to determine whether the device is in position. Other filtering and readings are possible to determine such things without departing from the scope of the present subject matter.

The present subject matter is demonstrated in the application of behind-the-ear (BTE), receiver-in-the-canal (RIC), and receiver-in-the-ear (RITE) hearing aids, but aspects may be used in designs including but not limited to, in-the-ear (ITE), in-the-canal (ITC), and completely-in-the-canal (CIC) type hearing aids. The present subject matter may provide aspects that can be used in hearing assistance devices generally, such as cochlear implant type hearing devices. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. An apparatus for use by a wearer, comprising:

a behind-the-ear housing having an outer surface;

hearing assistance electronics;

capacitive sensing electronics connected to the hearing assistance electronics; and a plurality of electrodes placed on or near the outer surface of the behind-the-ear housing and connected to the capacitive sensing electronics, the plurality of electrodes arranged to provide multiple rows wherein at least one row proximal the wearer's head is configured to be disabled to reduce false triggers; and ground traces configured to confine electric field lines to define switch zones, wherein the capacitive sensing electronics are adapted to detect motion of the wearer in proximity of the plurality of electrodes.

2. The apparatus according to claim 1, wherein the hearing assistance electronics are adapted to perform switch functions in response to a detection of the motion.

3. The apparatus according to claim 1, wherein the hearing assistance electronics are adapted to perform adjustable control functions in response to a detection of the motion.

4. The apparatus according to claim 3, wherein at least one adjustable control function of the adjustable control functions is programmable to be linear or logarithmic control.

5. The apparatus according to claim 3, wherein the hearing assistance electronics are also adapted to perform switch functions in response to a detection of the motion.

6. The apparatus according to claim 5, comprising a hybrid sensing switch including the plurality of electrodes and a piezoelectric element.

7. The apparatus according to claim 1, wherein the hearing assistance electronics are adapted to perform volume up and volume down functions in response to a sweeping motion performed at different positions along the plurality of electrodes.

8. The apparatus according to claim 7, wherein the hearing assistance electronics are adapted to perform one or more functions in response to a tapping motion performed at different positions along the plurality of electrodes.

9. The apparatus according to claim 8, comprising a hybrid sensing switch including the plurality of electrodes and a piezoelectric element.

10. The apparatus according to claim 1, wherein the hearing assistance electronics are adapted to perform one or more functions in response to a tapping motion performed at different positions along the plurality of electrodes.

11. The apparatus according to claim 1, comprising a portion contoured to accommodate a finger.

12. The apparatus according to claim 1, comprising a means for assisting the wearer in locating controls of the apparatus.

13. The apparatus according to claim 1, comprising a hybrid sensing switch including the plurality of electrodes and a piezoelectric element.

14. A method for operating a behind-the-ear hearing aid for use by a wearer, the method comprising:

providing a sensor on an outer surface of a housing of the behind-the-ear hearing aid, the sensor including a plurality of electrodes placed on or near the outer surface of the housing, the plurality of electrodes arranged to provide multiple rows wherein at least one row proximal the wearer's head is configured to be disabled to reduce false triggers the sensor including ground traces configured to confine electric field lines to define switch zones; and detecting a change in capacitance using the plurality of electrodes, the change in capacitance associated with motion of a wearer in proximity of the plurality of electrodes.

15. The method of claim 14, comprising performing a switch or adjustable control functions in response to a detection of the change in capacitance.

16. The method of claim 15, comprising detecting the change in capacitance associated with taps.

17. The method of claim 15, comprising detecting the change in capacitance associated with sweeps.

18. The method of claim 15, comprising detecting the change in capacitance associated with static presses.

19. The method of claim 15, comprising detecting the change in capacitance associated with patterns of motions.

20. The method of claim 15, comprising detecting the change in capacitance associated with one or more of taps, sweeps, static presses, motion patterns or combinations of thereof.

21. The method of claim 14, comprising adjusting a sensitivity for the detecting the change in capacitance to reduce false triggers.

* * * * *

UNITED STATES PATENT AND TRADEMARK OFFICE

CERTIFICATE OF CORRECTION

PATENT NO. : 8,824,712 B2
APPLICATION NO. : 12/905444
DATED : September 2, 2014
INVENTOR(S) : Michael Karl Sacha It is certified that error appears in the above-identified patent and that said Letters Patent is hereby corrected as shown below:

Title Page
On page 2, in column 2, under "Other Publications", line 32, delete "Examaination" and insert --Examination--, therefor Claims
In column 10, line 24, in Claim 14, after "triggers", insert --,--, therefor Signed and Sealed this
Second Day of February, 2016

Michelle K. Lee

Michelle K. Lee
*Director of the United States Patent and Trademark Office*